US007068800B2

(12) United States Patent
Matsuo

(10) Patent No.: US 7,068,800 B2
(45) Date of Patent: Jun. 27, 2006

(54) SPEAKER APPARATUS

(75) Inventor: Naoshi Matsuo, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 681 days.

(21) Appl. No.: 09/801,897

(22) Filed: Mar. 9, 2001

(65) Prior Publication Data

US 2001/0022835 A1 Sep. 20, 2001

Related U.S. Application Data

(63) Continuation of application No. PCT/JP99/02312, filed on Apr. 28, 1999.

(30) Foreign Application Priority Data

Sep. 9, 1998 (JP) ..... 10-255546

(51) Int. Cl.
*H04R 25/00* (2006.01)

(52) U.S. Cl. ..... 381/152; 381/388; 381/189; 381/190; 381/308; 381/17

(58) Field of Classification Search ..... 381/152, 381/388, 189, 190, 310, 308, 17
See application file for complete search history.

(56) References Cited

U.S. PATENT DOCUMENTS

| | | | | |
|---|---|---|---|---|
| 5,196,755 | A * | 3/1993 | Shields | 310/324 |
| 5,400,414 | A | 3/1995 | Thiele | 381/190 |
| 5,521,765 | A * | 5/1996 | Wolfe | 359/885 |
| 5,532,545 | A | 7/1996 | Okamoto et al. | 313/407 |
| 5,579,396 | A * | 11/1996 | Iida et al. | 381/18 |
| 5,799,094 | A | 8/1998 | Mouri | 381/18 |

FOREIGN PATENT DOCUMENTS

| | | |
|---|---|---|
| JP | 42-10178 | 6/1942 |
| JP | 60-101890 | 7/1985 |
| JP | 61-61598 | 3/1986 |
| JP | 62-73898 | 4/1987 |
| JP | 62-167496 | 10/1987 |

(Continued)

OTHER PUBLICATIONS

Verification of Translation filed Mar. 9, 2001 by Mr. Michiaki Nagai.

(Continued)

*Primary Examiner*—Huyen Le
*Assistant Examiner*—Justin Michalski
(74) *Attorney, Agent, or Firm*—Armstrong, Kratz, Quintos, Hanson & Brooks, LLP

(57) ABSTRACT

A speaker apparatus can ensure a large size and area of a diaphragm so as to improve reproducing capability in a low sound range and increase an output sound pressure, and can constitute a plurality of vibrating points (signal control points). An input signal Vin having a plurality of independent channels is inputted, then the signal input Vin is processed in a sound signal processing portion by calculating and adding of an interference canceling signal between the signal control points, by calculating and adding of a sound interference signal for causing the interference between outputs from the signal control points in an arbitrary point, etc., so as to be inputted to transducers that are attached to a single diaphragm. The transducer transduces an electric signal into mechanical vibration. A plurality of the signal control points are generated on the single diaphragm, and each signal control point cause the single diaphragm to vibrate. If the diaphragm is formed of a transparent material and attached to a display, it is possible to use a display screen as the speaker apparatus.

13 Claims, 13 Drawing Sheets

FOREIGN PATENT DOCUMENTS

| | | |
|---|---|---|
| JP | 62-269598 | 11/1987 |
| JP | 63-218350 | 9/1988 |
| JP | 63-280293 | 11/1988 |
| JP | 3-159500 | 7/1991 |
| JP | 4-501046 | 2/1992 |
| JP | 4-140999 | 5/1992 |
| JP | 4-157900 | 5/1992 |
| JP | 07-99030 | 4/1995 |
| JP | 7-154893 | 6/1995 |
| JP | 08-265899 | 10/1996 |
| JP | 9-130900 | 5/1997 |
| JP | 9-212270 | 8/1997 |
| JP | 09-230978 | 9/1997 |
| JP | 10-117397 | 5/1998 |
| JP | 10-234100 | 9/1998 |

OTHER PUBLICATIONS

Verification of Translation filed Mar. 9, 2001 by Ms. Yumiko Okura.

Copy of Japanese Office Action dated Feb. 3, 2006 issued in corresponding application, 4 pages.

* cited by examiner

SPEAKER APPARATUS

This application is a continuation of international application PCT/JP99/02312 filed on Apr. 28, 1999.

BACKGROUND OF THE INVENTION

1. Field of the Invention

The present invention relates to a speaker apparatus. In particular, the present invention relates to a flat-panel speaker apparatus. The speaker apparatus of the present invention can be applied also to a spherical speaker apparatus.

2. Description of the Related Art

A technique regarding a conventional speaker apparatus, a technique for reproducing a recorded signal by using a plurality of speaker apparatuses and using case of a small speaker apparatus in a computer system will be described in the following.

First, the technique regarding a speaker apparatus will be described. In addition to a cone-shaped speaker apparatus, a flat-panel speaker apparatus using a flat diaphragm have come into general use as a speaker apparatus. FIG. 10 shows a flat-panel speaker apparatus of the prior art. In FIG. 10, numeral 1010 denotes a diaphragm, numeral 1020 denotes a transducer, and numeral 1030 denotes a listener. For convenience in a description, a frame for supporting the diaphragm, etc. is omitted in FIG. 10. An input signal Vin is an electric signal as a sound signal, and is an analog signal. If an original source of sound information is provided as a digital signal, it is converted into an analog signal by means of a D/A (digital-analog) conversion, so as to obtain the input signal Vin. The input signal Vin is inputted to the transducer 1020. The transducer 1020 converts the electric signal as the sound signal into mechanical vibration. The transducer 1020 is attached to the diaphragm 1010, which converts the mechanical vibration from the transducer 1020 into a sound signal.

Amplitude spectrum and sound pressure of an output signal are important in a speaker apparatus. In other words, for reproducing various kinds of tones, it is preferable that the amplitude spectrum of the output signal is flat in a wide band range, and for reproducing a powerful signal, it is preferable that the sound pressure of the output signal is large. In the conventional speaker apparatus described above, by considering and adjusting a diaphragm material, the ratio of length and breadth of the diaphragm, a method for attaching the diaphragm to the frame and a method for attaching the transducer to the diaphragm, an almost flat amplitude spectrum can be achieved in a wide band range. On the other hand, for larger sound pressure of the output signal, there have been techniques in which the vibration capability of the transducer 1020 is enhanced to increase the vibration of the diaphragm 1010, and a plurality of transducers 1020 are attached to a single diaphragm 1010 in parallel so that the same signals are distributed and inputted to these transducers 1020.

Next, the technique for reproducing the recorded signal by using a plurality of the speaker apparatuses will be described.

FIGS. 11 and 12 illustrate concepts of recording and reproducing a signal. FIG. 11 illustrates the concept during recording, with numeral 1060 denoting a sound source, numeral 1070 denoting a virtual boundary, numeral 1040 denoting microphones and numeral 1030 denoting a listener. The virtual boundary 1070 is provided virtually for objectively defining a signal propagating from the sound source 1060 to the listener 1030. The signal outputted from the sound source 1060 passes through the virtual boundary 1070, so that the listener 1030 listens to this signal. It is ideal that all the sound passing through this virtual boundary 1070 is recorded, but from a viewpoint for practice, a plurality of the microphones 1040 are arranged on the virtual boundary 1070 for recording.

In the prior art, it is possible that the sound signal that has been recorded stereophonically is processed focusing on a phase difference, thereby estimating and synthesizing a sound passing through the other arbitrary points on the virtual boundary 1070.

FIG. 12 illustrates the concept of the ideal signal reproducing. Numeral 1050 denotes speaker apparatus. As is clear by comparing FIG. 12 with FIG. 11, each of the speaker apparatuses 1050 is arranged in a position corresponding to that of the microphone 1040 used for recording. A sound signal that has been recorded by the corresponding microphone 1040 is supplied to each of these speaker apparatuses 1050 as an input signal, and then is reproduced, so that a situation of recording the sound source can be reproduced precisely, achieving the ideal signal reproducing for the listener 1030.

Although there are five microphones 1040 and five speaker apparatus 1050 in FIGS. 11 and 12, these numbers are for convenience in description and not limited to five.

Next, a speaker wall (a speaker array) in which many speaker apparatuses are arranged on a wall surface as shown in FIG. 13 for achieving better signal reproducing is known in the prior art. In principle, this is configured by arranging many speaker apparatus shown in FIG. 12 on the wall surface. Ideally, a large wall surface is preferable for achieving a powerful sound in this speaker wall, while the speaker arrays in which many small speaker apparatuses are integrated so as to achieve a portable size also have been under development.

Next, the form of utilizing the small speaker apparatuses in the computer apparatus will be described.

Accompanying the recent development of multimedia technology in a computer apparatus, speaker apparatuses are utilized as a sound output device. The speaker apparatuses are arranged in such a manner that small speaker apparatuses are arranged externally on both sides of a control apparatus casing or inside the same.

The above-described speaker apparatus of the prior art have had the following problems.

First, in general, the listener arranges the speaker apparatuses in a room of various sizes and shapes, and recording is conducted in various situations, making it difficult to arrange a necessary number of speaker apparatus in the ideal positions shown in FIG. 12. Therefore, a voice that has been recorded in one environment has to be reproduced with a speaker located in the position other than a predetermined position. Consequently, a reproduced sound becomes different from the sound that should be obtained by reproducing a recorded sound properly.

Second, the speaker wall extending over the entire wall surface as shown in FIG. 13 is very expensive. Also, it is difficult to construct a speaker wall for a special purpose on a wall surface of a room inside an ordinary house. Thus, the speaker walls are not widespread very much.

Next, because the small speaker array is constituted by integrating small speaker apparatuses, the individual speaker apparatus that outputs signals is small, so that the size and area of the diaphragm of the speaker apparatus also are small. The small size of the diaphragm causes a lack of reproducing capability in a low sound frequency range with a long wavelength, and the small area of the diaphragm causes the output signal to have small sound pressure. In addition, since the small speaker apparatuses are integrated, the cost increases.

In addition, when the speaker apparatus is combined with the computer apparatus, a problem arises in both cases of external and internal arrangements. That is, in the case of the external speaker apparatus, limitation in a peripheral installation space of the computer apparatus often makes it difficult to install the speaker apparatus. On the other hand, in the case of internal speaker apparatus, the relationship with the other components in the computer apparatus casing makes it difficult to secure a sufficient loading space for the speaker, leading to the speaker apparatus having a small diaphragm, which has low reproducing capability in a low sound range and outputs sound with a small sound pressure.

SUMMARY OF THE INVENTION

In view of the problems of the conventional speaker apparatus described above, it is an object of the present invention to provide a speaker apparatus that secures a large size and area of a diaphragm so as to improve a reproducing capability in a low sound range and increase an output sound pressure and that can constitute a plurality of vibrating points (signal control points) on a single diaphragm in order to obtain various kinds of tones and stereophonic sound. It also is an object of the present invention to provide a speaker apparatus that can reproduce sound with a high quality even when the ideal number and arrangement of the speaker apparatuses are not possible. These speaker apparatuses will be provided in a low cost.

In order to achieve the above-mentioned object, a speaker apparatus of the present invention has a single diaphragm provided with a plurality of the transducers and a plurality of independent signal control points corresponding to the respective transducers.

With this configuration, it is possible to provide a plurality of the independent signal control points to an entire diaphragm of a flat-panel speaker apparatus. By supplying an input signal that has been subjected to an independent sound signal processing to each transducer, one diaphragm can stereophonically reproduce independent multi-channels. One diaphragm can have more signal control points than that in a conventional speaker apparatus, thus obtaining various kinds of tones and stereophonic sound effects. Also, the area of the diaphragm that one signal control point vibrates is the entire area of the panel, thus increasing a vibrating surface. In other words, the area of the diaphragm that one signal control point vibrates becomes larger than that in a speaker array apparatus in which a plurality of small speakers are integrated in the same area. Therefore, the speaker apparatus of the present invention can achieve a better reproducing capability in a low sound range and larger sound pressure of an output signal than the conventional speaker array apparatus. Furthermore, the speaker apparatus of the present invention has one diaphragm provided with a plurality of the transducers, achieving a simple configuration and less components, leading to lower manufacturing cost compared with the conventional speaker array apparatus in which a plurality of small speaker apparatus are integrated.

Next, it is preferable that a sound signal processing portion that is able to individually control the input electric signal to the respective transducers is installed, and an electric signal including a sound signal component for outputting a signal at the signal control point corresponding to the respective transducers and a sound interference canceling signal component for canceling an interference with the transducers serving as the other signal control points is provided, thereby making it possible to stereophonically reproduce a plurality of channels by the single diaphragm.

With this configuration, it is possible to cancel out an interference with other signal control points, which is generated because a plurality of the signal control points vibrate one diaphragm in a superimposed manner. Thus, with one diaphragm, multi-channel stereophonic outputs from a plurality of the independent signal control points can be obtained.

Next, it is preferable that the input electric signal to the respective transducers includes an interference sound signal component for causing an interference between sound outputs from the plurality of the signal control points so as to localize a sound image in an arbitrary point.

With this configuration, for example, in signals to be supplied to two signal control points, it is possible to include a signal for causing an interference between their outputs in a desired position. Thus, a point that is not provided with the transducer is used as a control target point in which a sound image is localized, thereby making a listener hear a sound as if a signal is being outputted from this point. With this effect, the number of the points where the sound images are produced so as to output the signal, namely, the number of the control target points can be made larger than the number of the transducers that are actually provided, namely, the number of the signal control points, thereby outputting richer sound quality and more stereophonic signals.

Next, it is preferable that the interference sound signal includes information for controlling a sound pressure distribution so as to control directionality of the sound image.

Because this configuration increases the directionality of the sound image, a sound effect can provide a richer stereophonic effect and reality. For example, by changing the sound image direction with time, it is possible to provide the listener a special effect as if an object outputting a signal or the like were moving a space around the listener. This effect is suitable for a speaker apparatus in game and video equipment.

Next, it is preferable that the interference sound signal includes a frequency characteristics correcting signal for correcting and adjusting frequency characteristics of an interference sound with respect to an arbitrary listening position and listening direction.

With this configuration, for example, even when the speaker apparatus has to be placed in a skew direction with respect to a predetermined position of a listener due to a limitation in a place for installation, it is possible to correct and adjust frequency characteristics of an output in the listening position and listening direction of the listener, thus providing the output with a high quality. This improves flexibility in an installation position and an installation direction of the speaker apparatus.

Next, it is preferable that the points in which the sound image is to be localized are arranged around a listener so as to achieve a surround stereo system.

This configuration can provide a richer stereophonic effect and reality so as to simulatively reproduce sound characteristics in a concert hall or a theater, and is suitable for speaker apparatus for experience-type game equipment using virtual reality. A conventional surround stereo system is expensive because a plurality of speaker apparatuses are arranged around a listener, while the speaker apparatus of the present invention can achieve a similar effect in an inexpensive manner.

Next, it is preferable that the diaphragm extends over an entire surface of a desired speaker array and is provided with the transducers whose number is the same as that of the signal control points of the desired speaker array.

With this configuration, the speaker apparatus of the present invention can replace a desired speaker array that has been used in a prior art, and shows the advantageous effect described above compared with the conventional speaker array apparatus. In other words, it is possible to obtain effects in which the speaker apparatus of the present invention not only has the same area and the same number of the signal control points provided with the transducers as the conventional desired speaker array so as to replace the same, but achieves the high reproducing capability in a low sound range and a simple structure leading to a lower cost as described above.

Next, it is preferable that the diaphragm extends over an entire surface of a desired speaker array, and the sound images are localized in positions of the signal control points of the desired speaker array.

With this configuration, the speaker apparatus of the present invention can replace a desired speaker array that has been used in a prior art, and the sound image is localized in a desired position by means of the interference of output signals of the signal control points, making it possible to configure the position and number of the transducers to be provided in a more flexible manner.

Next, it is preferable that the transducers are arranged in a peripheral portion of the diaphragm.

With this configuration, because a support member of the transducers does not have to be provided in the central portion, the support members of the diaphragm and the transducers are both configured to be in the peripheral portion, simplifying the manufacture. Furthermore, because the degree of spatial freedom increases in the central portion, a combination with the other apparatus is possible in the central portion.

Next, it is preferable that the diaphragm is formed of a transparent material.

With this configuration, the part hidden in the back side of the speaker apparatus can be seen, so that the part of the diaphragm of the speaker apparatus can have an application other than that as a signal outputting portion as well when the speaker apparatus is combined with the front surface of the other apparatus. In other words, although the area of the diaphragm of the conventional speaker apparatus has only had the application as an outputting portion of the speaker apparatus, the other apparatus parts covered with the speaker apparatus can be seen in the present invention. In particular, with the configuration in which the transducers are disposed in the peripheral portion of the diaphragm, the central portion is not provided with any structure other than the diaphragm made of the transparent material, so that the other apparatus in the back side can be seen as they are. This effect makes it possible to use one surface of a showcase or the like as a speaker.

As the transparent material, acrylic resin, polycarbonate or the like is preferable.

Next, it is preferable that the speaker apparatus having the diaphragm formed of the transparent material is attached to a front surface of a display of a monitor.

With this configuration, because the speaker apparatus can be attached to the display surface that is located straight in front of a listener utilizing a computer apparatus or the like, it is possible to organize a preferable signal outputting environment. Also, because the diaphragm is made of the transparent material, the display can be seen without any problem especially when the transducers are arranged in the peripheral portion of the diaphragm.

Next, it is preferable that the transparent material has function as a display filter for reducing a reflection of external light and blocking electromagnetic waves.

With this configuration, the speaker apparatus of the present invention to be attached to the front surface of the display can also serve as a filter having functions of preventing surrounding representation from being projected onto the display because of the reflection of the external light, which poses a problem in seeing the display, and blocking leakage electromagnetic waves from the display.

It also is possible to localize the sound image in a position of a picture of an object giving off a signal in a picture on the monitor. In this case, because a sound can be given off from the position where the sound is generated in the picture on the monitor, a viewer enjoys pictures and sound effects with more feeling of reality and experience, achieving a configuration suitable for games using virtual reality.

Next, it is preferable that the speaker apparatus of the present invention is integrated with a keyboard.

With this configuration, a signal can be outputted from the keyboard that is placed ahead of or in front of a user of a computer apparatus, so as to listen to the signal from there. Also, a display with an independent external casing does not have to be placed on the periphery of the installation position of the computer, thereby contributing to space saving. The speaker apparatus can be disposed inside or on the back surface the keyboard or the like.

In addition, the speaker apparatus of the present invention is characterized in that a single flat-panel diaphragm is provided with a plurality of the transducers, and the single flat-panel diaphragm is provided with a plurality of independent signal control points corresponding to the respective transducers.

With this configuration, the present invention can be applied to a flat-panel speaker apparatus.

DETAILED DESCRIPTION OF THE PREFERRED EMBODIMENTS

The following is a description of the embodiments of the present invention.

First Embodiment

A speaker apparatus of the first embodiment of the present invention will be described, with reference to the accompanying drawings.

In the speaker apparatus of the first embodiment, a single diaphragm is provided with a plurality of transducers, which are supplied individually with input electric signals that have been subjected to independent sound signal processings, so that the single diaphragm is provided with a plurality of independent signal control points. Furthermore, a signal for an output of the control point and a sound interference canceling signal for canceling the interference with outputs of the other control points are provided to a control point. The speaker apparatus of the first embodiment is a basic configuration of the present invention in which a single diaphragm is used for stereophonically reproducing a plurality of channels.

Figure 1:
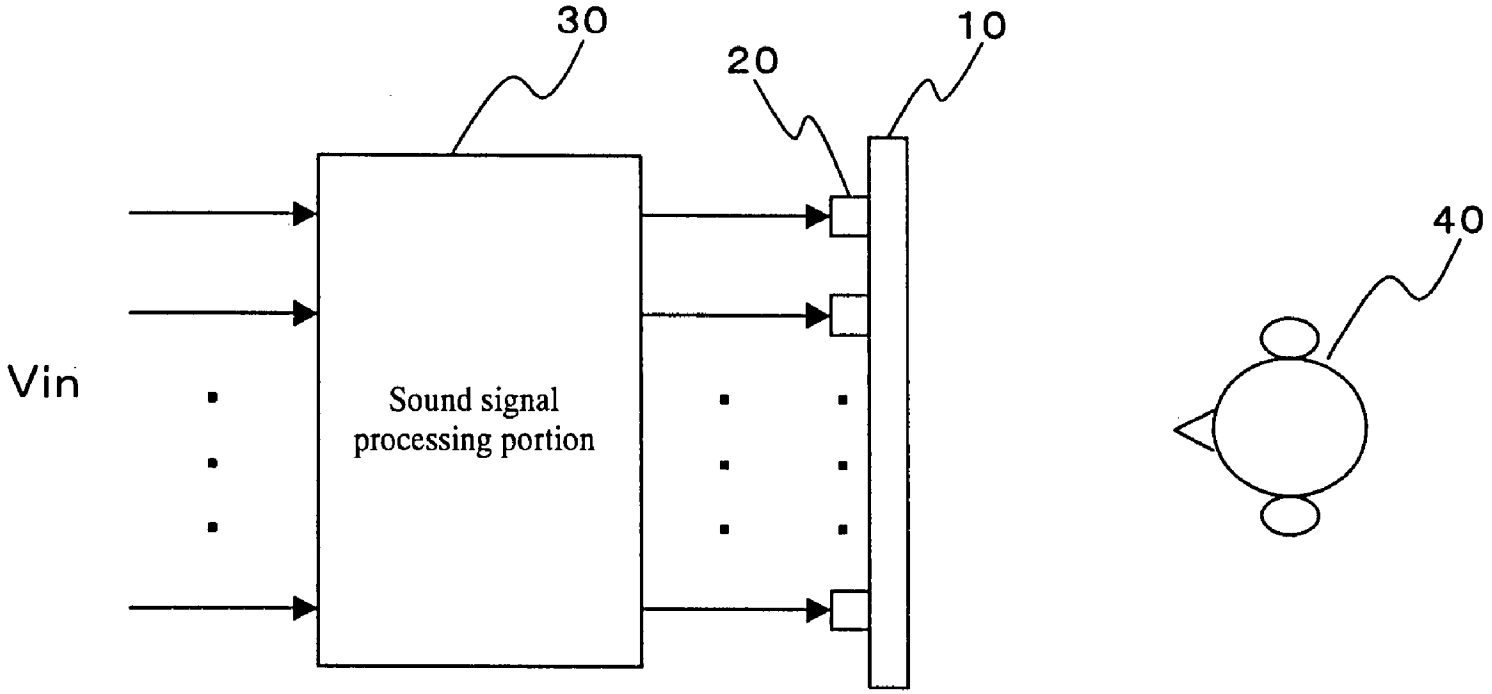
FIG. 1 is a schematic diagram of a basic configuration of a speaker apparatus of a first embodiment of the present invention.

FIG. 1 is a schematic diagram of the basic configuration of the speaker apparatus of the first embodiment of the present invention, and illustrates a basic principle of the speaker apparatus of the present invention. In FIG. 1, numeral 10 denotes a diaphragm, numeral 20 denotes transducers, numeral 30 denotes a sound signal processing portion, and numeral 40 denotes a listener. For convenience in a description, a frame for supporting the diaphragm, a casing of the speaker apparatus, etc., are omitted in FIG. 1.

An input signal Vin is an electric signal as an output signal. It is preferable that this input signal Vin is a digital signal because it is processed in the sound signal processing portion 30. In the description here, if an original source of information is provided as an analog signal, it is converted into a digital signal by means of an A/D conversion with an A/D (analog-digital) converter (not shown in the figure), so as to obtain the input signal Vin. The A/D converter may be arranged externally in a former stage part of the sound signal processing portion 30, or arranged inside the sound signal processing portion 30.

The input signal Vin may be a signal having a plurality of independent channels.

The sound signal processing portion 30 performs a digital signal processing on the acquired sound signal input Vin. The digital signal processing includes such processes as dividing the signal input Vin into signals, each corresponding to each predetermined signal control point, and calculating an interference canceling signal between signal control points and adding it to each of the signals, or calculating a sound interference signal between the other signal control points and adding it to each of the signals, which are to be described below. The sound signal processing portion 30 also performs a D/A conversion processing of a signal after the digital signal processing. The sound signal processing portion 30 outputs a plurality of analog signals that correspond to channels independently.

The signals that have been subjected to the digital signal processing by the sound signal processing portion 30 are inputted independently to the transducers 20. In the speaker apparatus of the present invention, the single diaphragm 10 is provided with a plurality of the transducers 20, which can be operated independently. The number of the transducers 20 may be different from or the same as that of the channels of the input signal Vin. The transducers 20 convert the electric signal of the input signal into mechanical vibration. The transducers 20 are attached to the diaphragm 10 and transmit the mechanical vibration to the diaphragm 10 through individual attached points.

The diaphragm 10 converts the mechanical vibration transmitted by a plurality of the transducers 20 to sound waves. A plurality of signal control points are generated on the diaphragm 10 here. The mechanical vibration to be provided to each of the signal control points is obtained by converting an independent sound signal, and each signal control point causes one entire diaphragm to vibrate. In other words, compared with a conventional speaker array apparatus, the present invention is the same in that a plurality of the control points are generated within a certain area, but is different clearly in the size of the diaphragm to be vibrated. In the invention of the present application, vibrating the entirety of the single large diaphragm makes it possible to improve reproducing capability in a low sound range with a long wavelength and to achieve a high sound pressure. On the other hand, in the conventional speaker array apparatus, the diaphragms to be vibrated by individual control points each have only a small vibrating area that is independent and partitioned off, so that the reproducing capability in a low frequency sound range and the sound pressure are both low.

In addition, the diaphragm 10 of the speaker apparatus of the first embodiment is a single diaphragm and not configured by integrating a plurality of diaphragms, as in the conventional speaker array apparatus. Therefore, frames such as a partition board, or other structures are not provided in the central portion of the diaphragm 10, thus achieving a simple structure and low manufacturing cost.

The listener 40 can listen to the sound waves outputted from the diaphragm 10. It is preferable that the listener 40 confronts the diaphragm 10. A plurality of the signal control points are generated on the diaphragm 10 and output the sound waves individually, achieving a multi-channel stereophonic reproducing, which leads to sound characteristics with much stereophonic effect and reality. Also, because the entirety of the large diaphragm 10 vibrates, excellent reproduction of music or the like that has a wide sound range and a high sound pressure can be achieved also in a low sound range.

Next, the elimination of influence of interference between the control points will be described.

Because the conventional speaker array apparatus is configured by integrating small speaker apparatuses, the influence of the interference between the partitioned speaker apparatus varies depending on individual conditions between the speaker apparatus, thus making it difficult to estimate the influence of the interference precisely. Consequently, in the conventional speaker array apparatus, it has not been possible to cancel the influence of the interference between the speaker apparatuses on the diaphragm. On the other hand, the speaker apparatus of the present invention has one diaphragm 10, and the signal control points share the entire diaphragm 10. The diaphragm 10 basically is made of a uniform material in the shape of a uniform flat plate and can estimate the interference between vibrations from the transducers 20. Accordingly, the sound signal processing portion 30 can calculate interference canceling signals for canceling the influence of the interference and add the interference canceling signals to the input signals, which then are outputted to the individual control points. This interference signal adding process by the sound signal processing portion 30 makes it possible to output a clear sound wave in which the influence of the interference between the control points is canceled effectively.

Second Embodiment

A speaker apparatus of the second embodiment of the present invention will be described, with reference to the accompanying drawings.

In the speaker apparatus of the second embodiment, an interference sound signal for causing interference between outputs of a plurality of signal control points is added as a signal that has been subjected to a sound signal processing, so as to localize a sound image in a desired point.

In principle, the speaker apparatus of the present invention can cause the interference between the outputs of a plurality of arbitrary signal control points so as to localize a sound image in an arbitrary position. However, in order to simplify the description, the second embodiment will discuss an example in which the sound image of an input of one channel is localized in a predetermined position S as described in the following.

Figure 2:
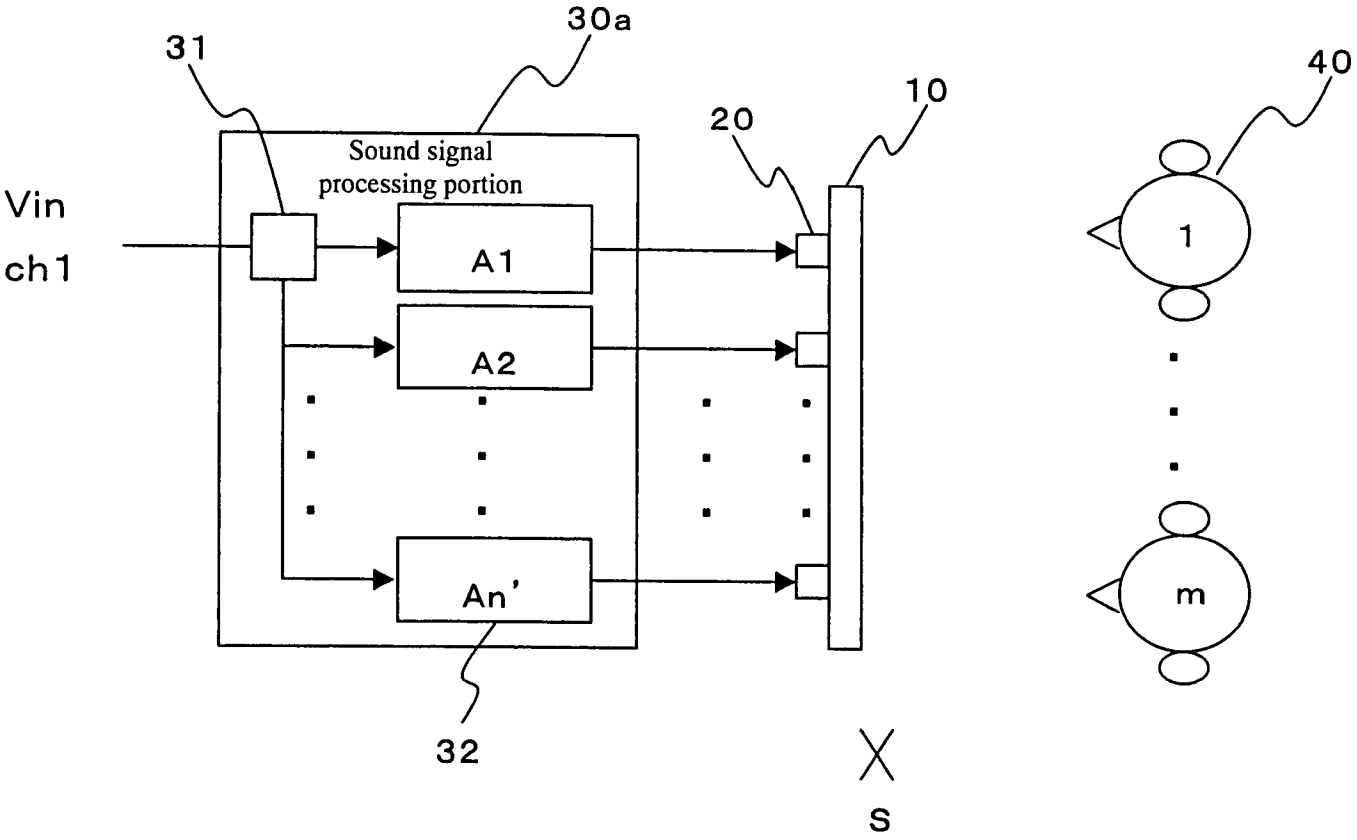
FIG. 2 is a schematic diagram of a basic configuration of a speaker apparatus of a second embodiment of the present invention.

FIG. 2 is a schematic diagram of the basic configuration of the speaker apparatus of the second embodiment of the present invention. In FIG. 2, ch1 denotes one channel signal of a sound input signal Vin, numeral 30*a* denotes a sound signal processing portion, numeral 20 denotes transducers, numeral 10 denotes a diaphragm, numeral 40 denotes listeners, and S indicates a position in which a sound image is to be localized. In the speaker apparatus of the present invention, in principle, the number of the transducers n' and the number of the listeners m may be the same as or different from the number of the channels n. The same reference numerals are attached to the elements corresponding to those described in the first embodiment, and the description of the parts operating in the same manner as in the first embodiment will be omitted suitably.

ch1 of the input signal Vin is only one channel signal, which is for convenience in a description. It is needless to say that, in an actual operation, inputs of a plurality of channels can be superimposed so as to be inputted to the speaker apparatus of the present invention. Signals of ch2, . . . , ch(n) can be processed so as to localize sound images in different positions.

ch1 of the input signal Vin is inputted to the sound signal processing portion 30*a*.

The sound signal processing portion 30*a* is provided with a signal distributor 31 and finite impulse response type filters (abbreviated as FIR filters in the following) A1, A2, . . . , An'. First, the inputted signal input ch1 of one channel signal is divided into signals, each corresponding to each transducer (each signal control point), with the signal distributor 31, and then distributed to the FIR filters A1, A2, . . . , An'. These FIR filters A1, A2, . . . , An' process the signals, thereby causing interference between the signals outputted from the signal control points in arbitrary points so as to produce the sound image.

The coefficients $a_i1, \ldots, a_ik$ (i=1, . . . , n', k is an order of the filter) of the FIR filters A1, A2, . . . , An' will be calculated in the following manner.

Impulse responses indicating sound characteristics from the transducers 20 to the left and right ears of the listeners 40 are expressed by $t_iL_j(p)$ and $t_iR_j(p)$ respectively (i=1, . . . , n', j=1, . . . , m, p=1, . . . , 1: sample number). Impulse responses indicating sound characteristics from the position S in which the sound image of ch1 is to be localized to the both ears of the listeners are expressed by $SL_j(p)$ and $SR_j(p)$ respectively (j=1, . . . , m). Thus, the differences $eL_j(p)$ and $eR_j(p)$ between the sound from the position S and that from the individual voice control points (transducers) with respect to the both ears of the listeners are expressed by Equation 1 and Equation 2.

$$eL_j(p) = sL_j(p) - \sum_{i=1}^{n'} \left\{ \sum_{q=1}^{k} a_{iq} t_i L_j(p+1-q) \right\} \quad \text{Equation 1}$$

$$eR_j(p) = sR_j(p) - \sum_{i=1}^{n'} \left\{ \sum_{q=1}^{k} a_{iq} t_i R_j(p+1-q) \right\} \quad \text{Equation 2}$$

In Equation 1 and Equation 2, the left side $eL_j(p)$ and $eR_j(p)$ represent an error between the ideal sound ($sL_j(p)$, $sR_j(p)$) at the position S in which the sound image is desired to be localized and the synthesized sound (the terms having Σ in Equation 1 and Equation 2) that is obtained actually by the individual voice control points (transducers). Accordingly, when the powers of $eL_j(p)$ and $eR_j(p)$ both become zero, the listeners hear the sound images being produced in the position S.

In order that the powers of $eL_j(p)$ and $eR_j(p)$ both become zero, an evaluation function J with respect to $eL_j(p)$ and $eR_j(p)$, which is necessary for calculating the coefficients $a_i1, \ldots, a_ik$ of the FIR filters, is now determined as shown in Equation 3.

$$J = \sum_{p=1}^{l} \sum_{j=1}^{m} (\alpha L_j(eL_j(p))^2 + \alpha R_j(eR_j(p))^2) \quad \text{Equation 3}$$

In Equation 3, $\alpha L_j$ and $\alpha R_j$ represent weightings with respect to how the listeners hears the sound with the left ear (L) and the right ear (R) respectively.

The coefficients $a_i1, \ldots, a_ik$ of the filters are calculated such that the value of this evaluation function J becomes minimum. For this purpose, a maximum gradient method can be used. When a vector having the coefficients $a_i1, \ldots, a_ik$ of the filters as its elements is expressed by $a_i$, by calculating Equation 4 repeatedly, the vector $a_i$ that reduces the value of J can be obtained. Here, r of $a_i^{(r)}$ represents the number of times to be repeated. In addition, β represents a constant (0<β<1), and $\partial J/\partial a_i^{(r)}$ indicates partially differentiating J with respect to $a_i^{(r)}$.

$$a_i^{(r+1)} = a_i^{(r)} - \beta \frac{\partial J}{\partial a_i^{(r)}} \quad \text{Equation 4}$$

By using the above-described FIR filters A1, A2, . . . , An', the speaker apparatus of the present invention can produce the sound image in an arbitrary point as an output. The sound image of each channel may be localized on the diaphragm or out of the diaphragm.

Furthermore, by moving the position in which the sound image of the channels is localized, it also is possible to make the listener feel as if there is an object moving around the listener while giving off a signal. This effect provides a stereophonic effect and reality in the output of the speaker apparatus, which is made suitable for experience-type virtual reality games.

Third Embodiment

A speaker apparatus of the third embodiment of the present invention will be described, with reference to the accompanying drawings.

In the speaker apparatus of the third embodiment, information for controlling the direction of sound image localization is included in a signal that has been subjected to a sound signal processing, so as to control the direction of the sound image to be localized, thus the speaker apparatus can control sound directionality.

In principle, the speaker apparatus of the present invention can control outputs of a plurality of arbitrary signal control points so as to control sound pressure in a plurality of arbitrary positions. However, in order to simplify the description, the third embodiment will discuss an example in which the sound image is localized in one predetermined position M.

Figure 3:
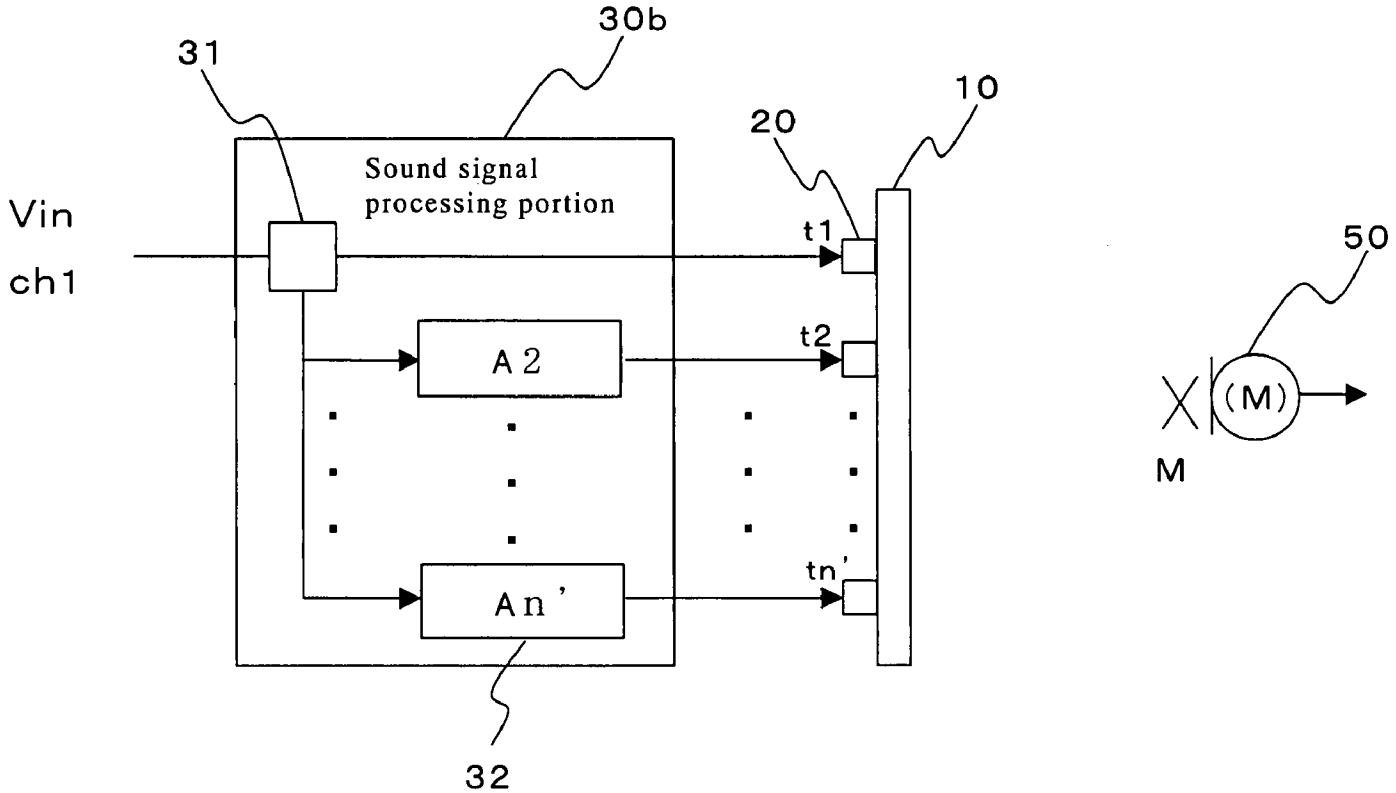
FIG. 3 is a schematic diagram of a basic configuration of a speaker apparatus of a third embodiment of the present invention.

FIG. 3 is a schematic diagram of the basic configuration of the speaker apparatus of the third embodiment of the present invention. In FIG. 3, ch1 denotes one channel signal of an input signal Vin, numeral 30*b* denotes a sound signal processing portion, numeral 20 denotes transducers, numeral 10 denotes a diaphragm, numeral 50 denotes a microphone, and M indicates a position in which a sound image is to be localized. In the speaker apparatus of the present invention, in principle, the number of the transducers n' and the number of the listeners m may be the same as or different from the number of the channels n. The same reference numerals are attached to the elements corresponding to those described in the first and second embodiments, and the description of the parts operating in the same manner as in the first and second embodiments will be omitted suitably.

ch1 of the input signal Vin is inputted to the sound signal processing portion 30*b*.

The sound signal processing portion 30*b* is provided with a signal distributor 31 and FIR filters A2, . . . , An'. In the third embodiment, a control point by a transducer t1 serves as a reference point, so the FIR filter is not provided with respect to the input signal to the transducer t1.

The microphone 50 is arranged in the position M where it is desired to improve the directionality and to increase sound pressure, and the sound pressure will be measured in this position M. It is appropriate to define coefficients of the FIR filters such that this microphone (M) collects the maximum sound pressure.

First, impulse signals are inputted to transducers t1 to tn' sequentially, so that impulse responses $t_iM(p)$ (i=1, . . . , n', p=1, . . . , 1: sample number) indicating sound characteristics from the transducers t1 to tn' to the microphone 50 are measured. A filter $A_i$ (i=2, . . . , n') is set to be used so that waveforms of these impulse responses match.

The coefficients $a_i1, \ldots, a_ik$ (i=2, . . . , n', k is an order of the filter) of the filter $A_i$ will be calculated in the following manner.

The difference $e_i(p)$ (i=2, . . . , n') between the synthesized sound of outputs from control points of the transducers t2, . . . , tn' and the output signal from the control point of the transducer t1 as the reference is given by Equation 5.

$$e_i(p) = t_1M(p) - \sum_{q=1}^{k} a_{iq}t_iM(p+1-q) \qquad \text{Equation 5}$$

An evaluation function $J_i$ of $e_i(p)$, which is used for calculating the coefficients of the filters, is now determined as in Equation 6.

$$J_i = \sum_{p=1}^{l} e_i(p)^2 \qquad \text{Equation 6}$$

The coefficients $a_i1, \ldots, a_ik$ of the filters are calculated such that the value of this evaluation function $J_i$ becomes minimum. For this purpose, a maximum gradient method can be used. The calculation by means of the maximum gradient method is the same as that in the second embodiment, so the description thereof is omitted here.

Also, in the third embodiment, a position where the directionality is controlled so as to increase the sound pressure is selected as one of the positions M, and the sound pressure has been measured using one microphone 50. However, when a plurality of positions where the directionality is controlled so as to increase the sound pressure are desired, the individual signals can be processed using a plurality of microphones in a similar manner, thereby controlling the sound pressure in a plurality of the positions.

Fourth Embodiment

A speaker apparatus of the fourth embodiment of the present invention will be described, with reference to the accompanying drawings.

In the speaker apparatus of the fourth embodiment, points in which sound images are to be localized are arranged around a listener, thus achieving a surround stereo system.

In principle, the speaker apparatus of the present invention can cause the interference between the outputs of a plurality of arbitrary control points so as to localize a sound image in an arbitrary position. However, in order to simplify the description, the fourth embodiment will discuss a surround stereo system having five channels of center (c), left front (L), right front (R), left back (SL) and right back (SR) as an example.

Figure 4:
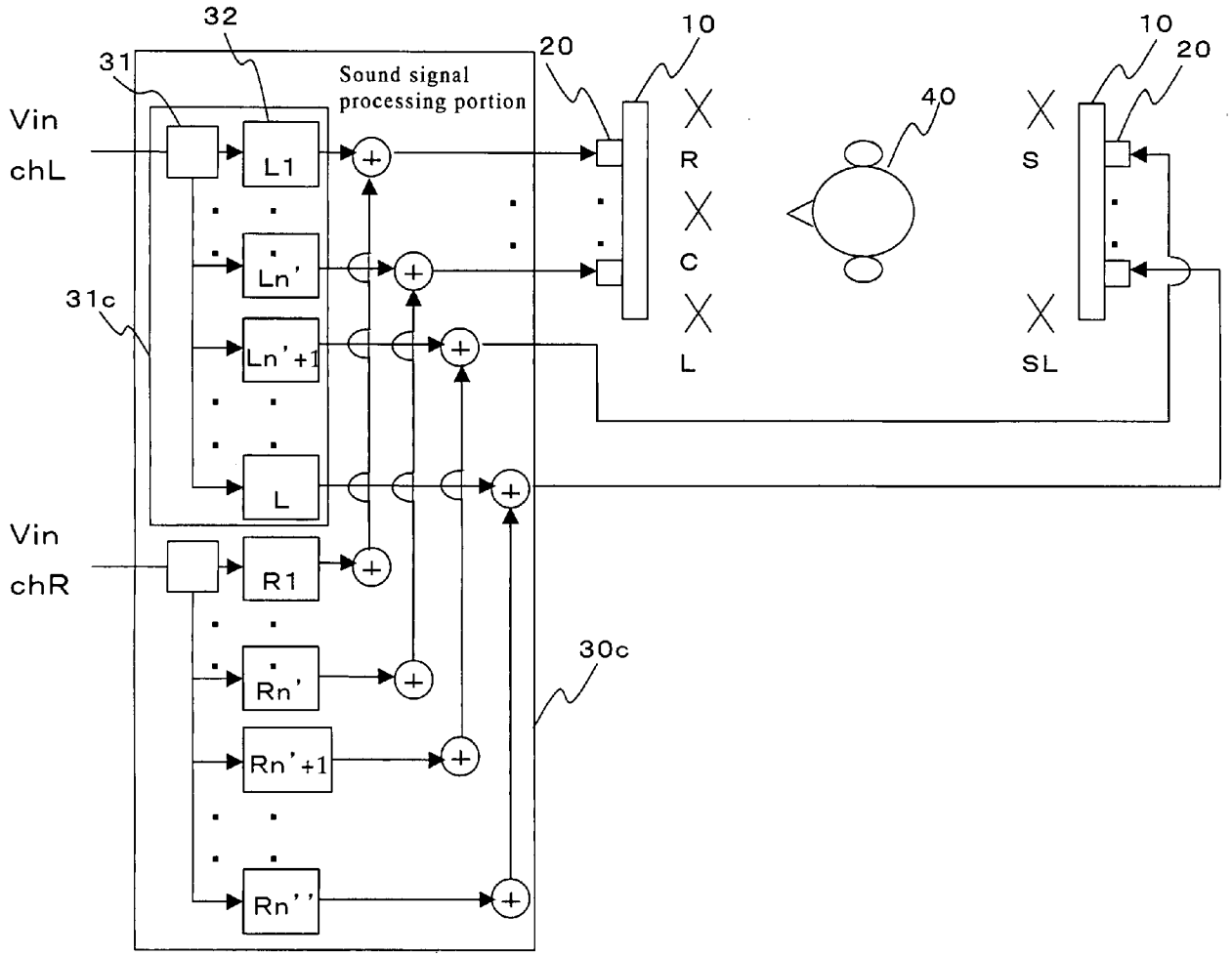
FIG. 4 illustrates a basic configuration of a speaker apparatus of a fourth embodiment of the present invention in which a surround stereo system is achieved.

FIG. 4 is a diagram of the basic configuration of the speaker apparatus of the fourth embodiment of the present invention in which the surround stereo system is achieved.

In FIG. 4, chL denotes the left front channel signal of an input signal Vin, and chR denotes the right front channel signal of an input signal Vin. Numeral 30*c* denotes a sound signal processing portion, numeral 20 denotes transducers, numeral 10 denotes diaphragms, numeral 40 denotes a listener, and localization positions C, L, R, SL and SR indicate positions in which signals of the respective channels localize a sound image.

For convenience in a description, input signals Vin that correspond to the center channel chC, the left back channel chSL and the right back channel chSR and filters in the sound signal processing portion 30*c* are not shown in the figure because they have the same configuration as those in the figure. In the speaker apparatus of the present invention, in principle, the number of the transducers n' and the number of the listeners m may be the same as or different from the number of the channels n. The same reference numerals are attached to the elements corresponding to those described in the first and second embodiments, and the description of the parts operating in the same manner as in the first and second embodiments will be omitted suitably.

The input signal Vin of the left front channel chL is inputted to the sound signal processing portion 30*c*, to which a sound interference signal for localizing the sound image in the localization position L is added by a filter 31*c* so as to vibrate the transducer 20. The output to the diaphragm 10 localizes the sound image in the localization position L by means of interference. In the similar manner, the other channels localize the sound images in the localization positions R, C, SL and SR, thus configuring the surround stereo system having five channels around the listener 40.

It is possible to control the localization of the sound images of the five channels of C, L, R, SL and SR by the method for localizing the sound images described in the second embodiment, etc., and the coefficients of the filters also can be selected similarly.

In the above description of the fourth embodiment, one speaker apparatus each is placed in front of and behind the listener to achieve five-channel stereo of C, L, R, SL and SR. However, when localizing the control points of the five channels, signals to be supplied to the transducers in the two speaker apparatus in the front and back may be controlled together. Alternatively, it may be possible that the front speaker apparatus alone localizes the sound images of three channels of C, L and R, while the back speaker apparatus alone localizes the sound images of two channels of SL and SR.

In addition, although two speaker apparatus have been arranged in front of and behind the listener in this embodiment, the configuration is not necessarily limited to the above when organizing the surround stereo system because, in accordance with the speaker apparatus of the present invention, the sound images can be localized in an arbitrary position and in an arbitrary number. Only one speaker apparatus that is provided in front of or behind the listener also can achieve the five-channel stereo system.

Fifth Embodiment

A speaker apparatus of the fifth embodiment of the present invention will be described, with reference to the accompanying drawings.

In the speaker apparatus of the fifth embodiment, a frequency characteristics correcting signal is included for correcting and adjusting frequency characteristics of an output to an arbitrary listening position and listening direction. Even when the speaker apparatus is located in a skew direction with respect to a listener, it can correct the frequency characteristics of the output in the listening position and listening direction of the listener, thus providing the output with a high quality.

The fifth embodiment illustrates the case where the speaker apparatus is placed in a skew manner with respect to the listener's listening direction.

Figure 5:
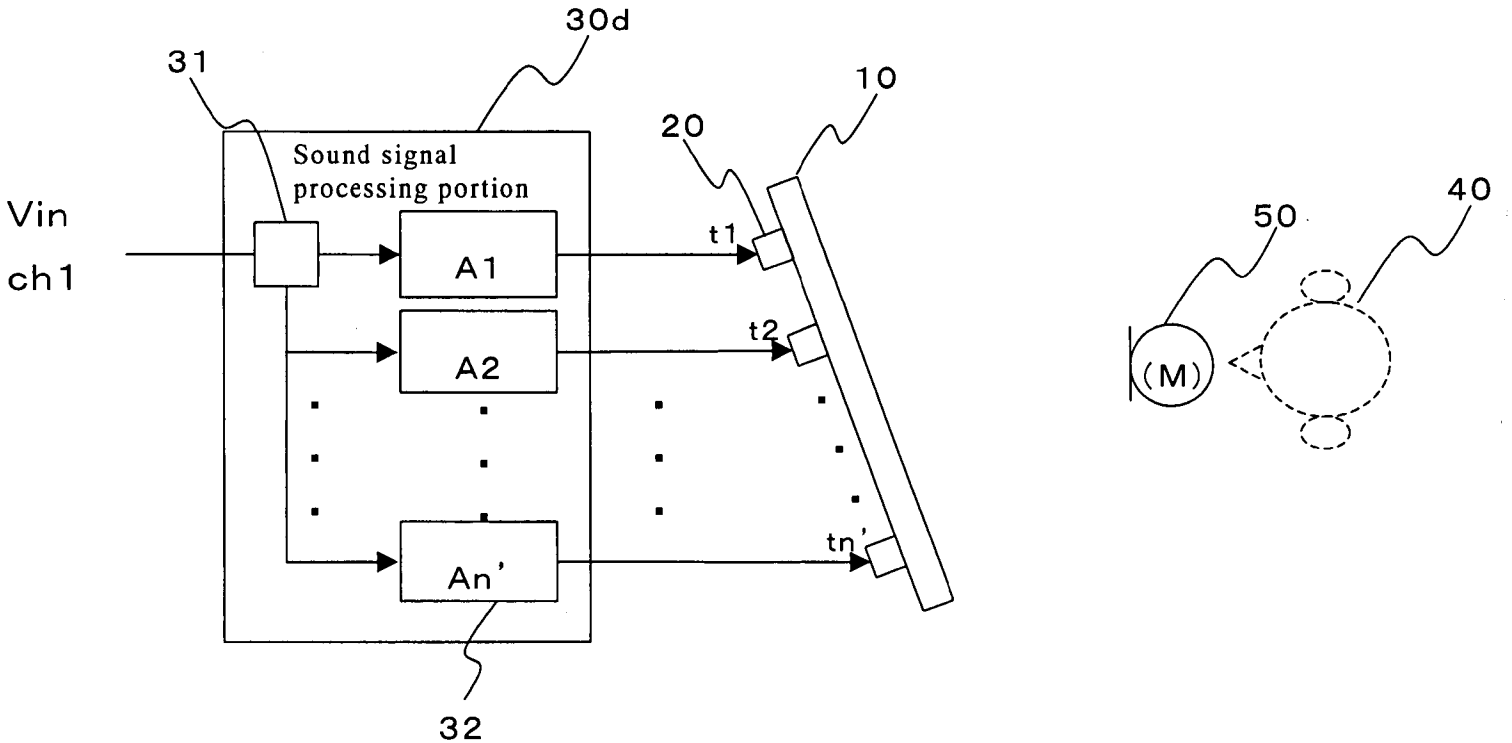
FIG. 5 is a diagram conceptually showing a basic configuration of a speaker apparatus of a fifth embodiment of the present invention.

FIG. 5 is a diagram conceptually showing a basic configuration of the speaker apparatus of the fifth embodiment of the present invention.

In FIG. 5, Vin denotes an input signal, numeral 30*d* denotes a sound signal processing portion, numeral 20 denotes transducers, numeral 10 denotes a diaphragm, numeral 40 denotes a listener, and numeral 50 denotes a microphone. The sound signal processing portion 30*d* is provided with a signal distributor 31 and digital filters A1 to An'. The digital filters A1 to An' here are FIR filters similar to the digital filters shown in the second embodiment. As shown in FIG. 5, the listening direction of the listener 40 is a horizontal direction of FIG. 5, and the direction of a vibrating surface of the diaphragm 10 is arranged in a skew manner with respect to the listening direction.

In the fifth embodiment, it is appropriate that the digital filters A1 to An' perform a correction and adjustment processing for improving the frequency characteristics of the output to be heard by the listener. The processing content by the digital filters A1 to An' will now be described. The processing content by the digital filters A1 to An' is considered appropriate if the microphone 50 that is placed in the position of the listener 40 collects a sound wave having the ideal frequency characteristics.

Impulse signals are inputted to transducers t1 to tn' sequentially, so that impulse responses $t_iM(p)$ (i=1, . . . , n', p=1, . . . , 1: sample number) indicating sound characteristics from the control points by the transducers t1 to tn' to the microphone 50 are measured. A filter $A_i$ (i=1, . . . , n') performs processing so that waveforms of these impulse responses become a waveform of a desired impulse response ir(p), for example, the frequency characteristics achieve a flat waveform in a range of audio frequencies of humans.

The coefficients $a_i1, \ldots, a_ik$ (i=1, . . . , n', k is an order of the filter) of this filter will be calculated by a process similar to that in the third embodiment.

The difference $e_i(p)$ (i=1, . . . , n') between the synthesized sound of outputs from control points of the transducers t1, . . . , tn' and the desired impulse response ir(p) is given by Equation 7.

$$e_i(p) = ir(p) - \sum_{q=1}^{k} a_{iq} t_i M(p+1-q) \qquad \text{Equation 7}$$

An evaluation function $J_i$ of $e_i(p)$, which is used for calculating coefficients of the filters, is now determined as in Equation 8.

$$J_i = \sum_{p=1}^{l} e_i(p)^2 \qquad \text{Equation 8}$$

The coefficients $a_i1, \ldots, a_ik$ of the filters are calculated such that the value of this evaluation function $J_i$ becomes minimum. For this purpose, a maximum gradient method can be used as in the second embodiment. The description thereof is omitted here.

Sixth Embodiment

A speaker apparatus of the sixth embodiment of the present invention will be described, with reference to the accompanying drawings.

In the speaker apparatus of the sixth embodiment, an interference signal includes a frequency characteristics correcting signal for correcting and adjusting frequency characteristics of output sound to an arbitrary listening position and listening direction, as in the speaker apparatus illustrated in the fifth embodiment. In the sixth embodiment, when it is impossible to place a diaphragm so as to confront a listener, for example, as a result of an influence of a casing design of the speaker apparatus, the speaker apparatus of this sixth embodiment can correct the frequency characteristics of the output to the listener, thus providing the output with a high quality.

Figure 6:
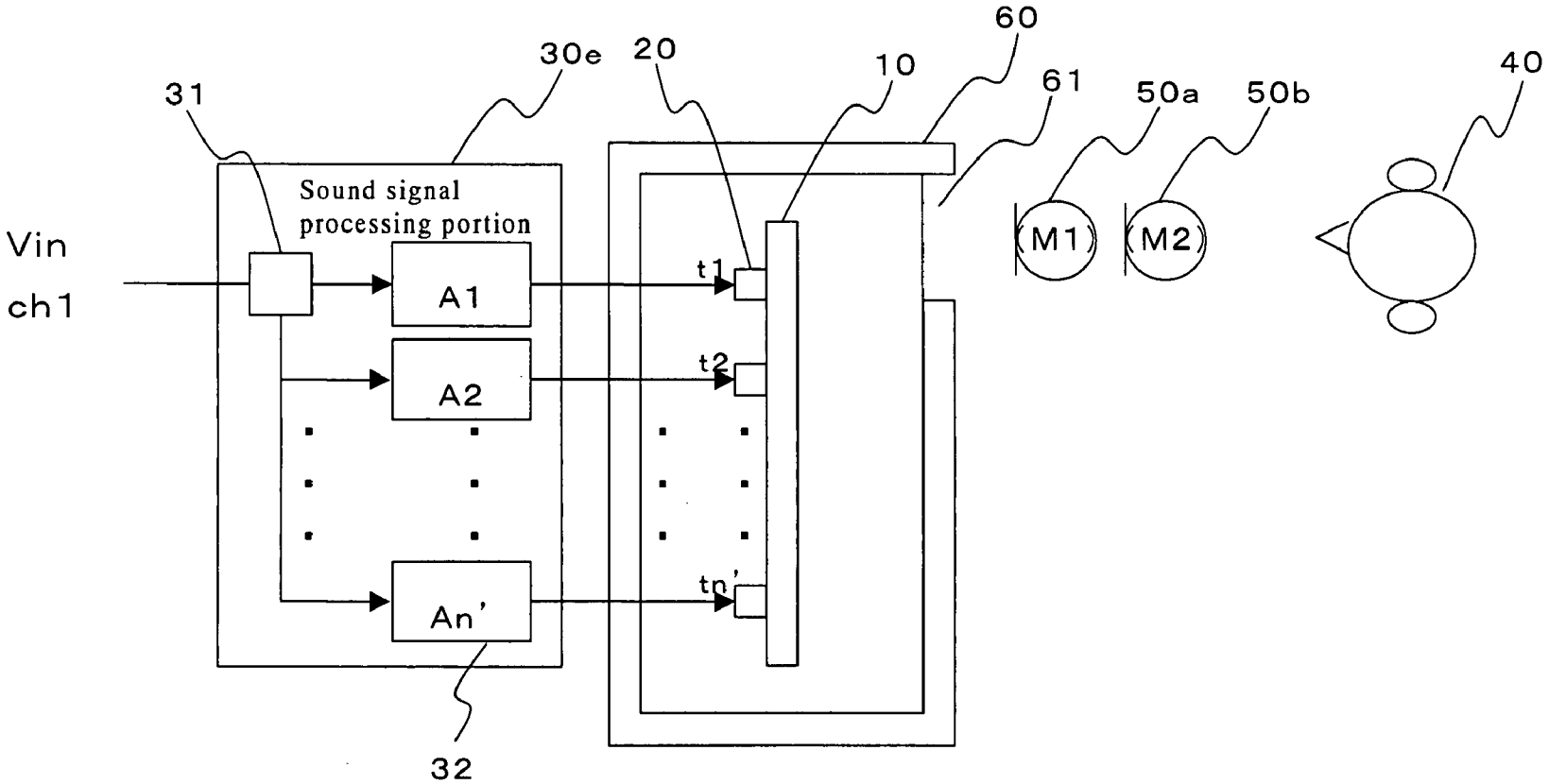
FIG. 6 is a diagram conceptually showing a basic configuration of a speaker apparatus of a sixth embodiment of the present invention.

FIG. 6 is a diagram conceptually showing a basic configuration of the speaker apparatus of the sixth embodiment of the present invention.

In FIG. 6, Vin denotes an input signal, numeral 30*e* denotes a sound signal processing portion, numeral 20 denotes transducers, numeral 10 denotes a diaphragm, numeral 40 denotes a listener, and numerals 50*a* and 50*b* denote microphones, and numeral 60 denotes a speaker apparatus casing. Signals are outputted only from a sound outlet 61, and the speaker casing is located in front of the diaphragm 10 in the direction of a vibrating surface so as to have a structure in which the sound cannot be outputted directly in the front direction. The sound signal processing portion 30*e* is provided with a signal distributor 31 and digital filters A1 to An'. The digital filters A1 to An' here are FIR filters similar to the digital filters shown in the second embodiment. As shown in FIG. 6, the listening direction of the listener 40 is a horizontal direction in the listener's position.

In the sixth embodiment, it is appropriate that the digital filters A1 to An' perform a correction and adjustment processing for improving the frequency characteristics of a sound wave outputted from the sound outlet 61 in the direction and position of the listener. The processing content by the digital filters A1 to An' will now be described. It is appropriate to determine the processing of the digital filters A1 to An' so that two microphones 50*a* and 50*b* that are placed horizontally in the listening direction ahead of the listener 40 and near the sound outlet 61 collect sound having the ideal frequency characteristics.

Impulse signals are inputted to transducers t1 to tn' sequentially, so that impulse responses $t_iM_1(p)$ and $t_iM_2(P)$ (i=1, . . . , n', p=1, . . . , 1: sample number) indicating sound characteristics from the control points by the transducers t1 to tn' to the microphones are measured. A filter Ai (i=1, . . . , n') performs processing so that waveforms of these impulse responses become the waveforms of desired impulse responses $ir_1(p)$ and $ir_2(p)$, for example, the frequency characteristics achieve a flat waveform in a range of audio frequencies of humans.

The coefficients $a_i1, \ldots, a_ik$ (i=1, . . . , n', k is an order of the filter) of this filter will be calculated by a process similar to that in the third embodiment.

The differences $e_{1i}(p)$ and $e_{2i}(p)$ (i=1, . . . , n') between the synthesized sound of outputs from control points of the transducers t1, . . . , tn' and the desired impulse responses $ir_1(p)$ and $ir_2(p)$ are given by Equations 9.

Equations 9

$$e_{1i}(p) = ir_1(p) - \sum_{q=1}^{k} a_{iq} t_i M_1(p+1-q)$$

$$e_{2i}(p) = ir_2(p) - \sum_{q=1}^{k} a_{iq} t_i M_2(p+1-q)$$

Evaluation functions $J_{1i}$ and $J_{2i}$ of $e_{1i}(p)$ and $e_{2i}(P)$, which are used for calculating the coefficients of the filters, are now determined as in Equations 10.

Equations 10

$$J_{1i} = \sum_{p=1}^{l} e_{1i}(p)^2$$

$$J_{2i} = \sum_{p=1}^{l} e_{2i}(p)^2$$

The coefficients $a_i1, \ldots, a_ik$ of the filters are calculated such that the values of these evaluation functions $J_{1i}$ and $J_{2i}$ become minimum. For this purpose, a maximum gradient method can be used as in the second embodiment. The description thereof is omitted here.

As described above, in accordance with the speaker apparatus of the sixth embodiment, it is possible to control the sound pressure (measured value of the microphone) and the speed of an air particle generated by particle velocity (difference in the sound pressure) that define a sound wave, so that sound quality can be adjusted in the direction of a predetermined position of the listener.

Seventh Embodiment

A speaker apparatus of the seventh embodiment of the present invention will be described, with reference to the accompanying drawings.

In the speaker apparatus of the seventh embodiment, a conventional speaker array apparatus is replaced by the speaker apparatus having a simple structure of the invention of the present application, in which a diaphragm extends over an entire surface of a desired speaker array so as to localize the sound image in positions of control points of the desired speaker array.

The speaker array apparatus can be understood with a plurality of independent diaphragms in a certain area and control points formed on the individual diaphragms. A sound wave outputted from each control point can be expressed by a sound ray vector having a certain direction and sound pressure.

In the description of the seventh embodiment, the control of one sound ray vector will be illustrated for convenience. Practically, the speaker array apparatus can be replaced by performing a similar processing with respect to each sound ray vector in a certain position and number.

Figure 7:
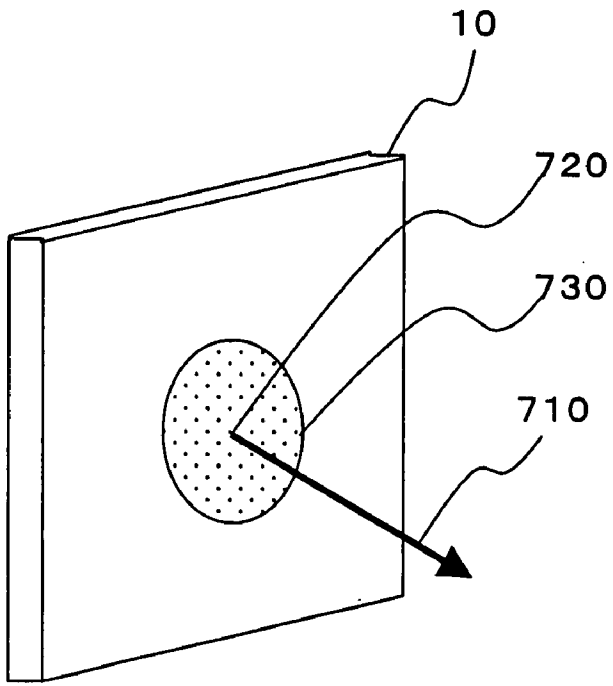
FIG. 7 illustrates one sound ray vector 710 that is generated on a diaphragm of a seventh embodiment.

FIG. 7 illustrates one sound ray vector 710 that is generated on a diaphragm. In order to obtain a preferable sound ray vector as shown in FIG. 7, it is necessary that a peripheral portion 730 of a control point 720 generating the sound ray vector should vibrate in a desired manner similar to that in a conventional speaker wall and that, in the other portion, interference should be canceled to suppress the vibration.

When controlling the vibration of a diaphragm 10, filters for processing input signals for individual transducers are used as illustrated in the third embodiment. A plurality of vibration pickups (for example, accelerometers: not shown in the figure) are attached to the diaphragm 10 so as to measure the vibration. The measured value is processed similarly to the third embodiment, so that the coefficients of the filters are calculated. In other words, it is appropriate to determine the coefficients of the filters such that the vibration and output measured in the position other than the peripheral portion 730 of the control point 720 on the diaphragm 10 become zero.

Eighth Embodiment

A speaker apparatus of the eighth embodiment of the present invention will be described, with reference to the accompanying drawings.

The speaker apparatus of the eighth embodiment is obtained by devising the configuration of the speaker apparatus of the invention of the present application that has been described in the above embodiments. That is, transducers are arranged in a peripheral portion of a diaphragm, and the diaphragm is formed of a transparent material, so that the speaker apparatus is attached to the front surface of a display of a monitor of a personal computer.

Figure 8:
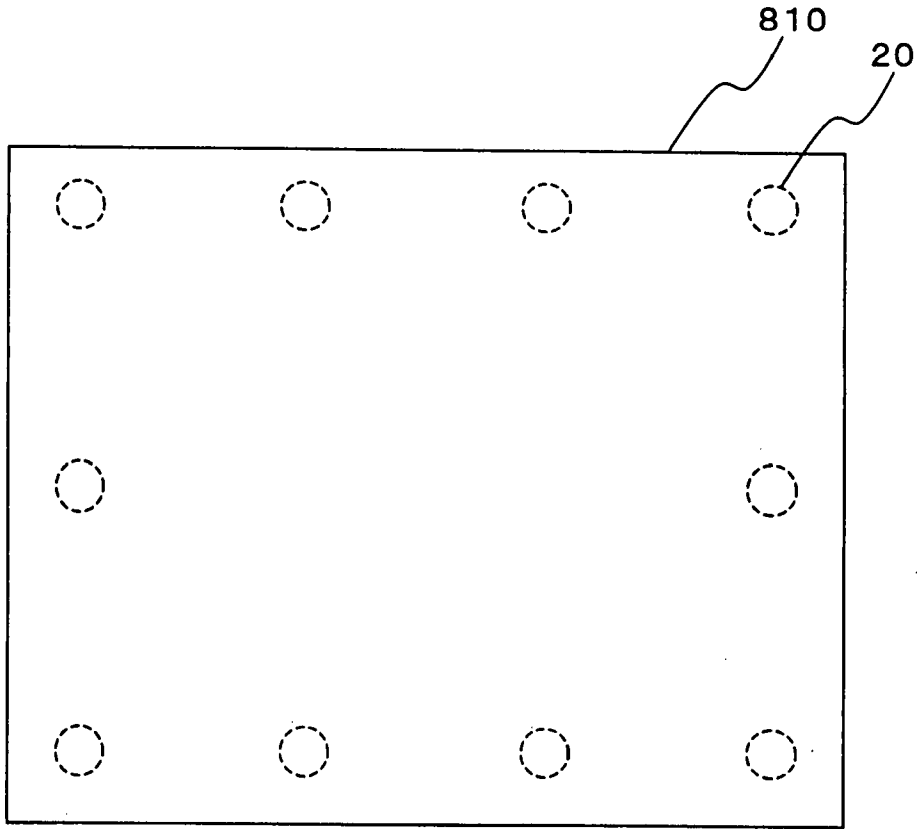
FIG. 8 illustrates a schematic configuration of a speaker apparatus of an eighth embodiment of the present invention when seen from a front side.

FIG. 8 illustrates a schematic configuration of the speaker apparatus of the eighth embodiment when seen from a front side. In FIG. 8, numeral 810 denotes a diaphragm and numeral 20 denotes transducers. The other structures such as a support member and wiring are omitted here. As shown in FIG. 8, the transducers 20 are arranged in the peripheral portion of the diaphragm and not arranged in the central portion. The diaphragm 810 is formed of a transparent material such as acrylic resin or polycarbonate, and has a hardness and a thickness that can transduce mechanical vibration from the transducers 20 to signals with an excellent quality. Thus, the diaphragm 810 should be the one that can be applied to the above-described embodiments and through which the other side of the diaphragm can be seen.

When the speaker apparatus shown in FIG. 8 is attached to the front surface of the display of the monitor of the personal computer, a user can see a display panel without any problem because the transducers 20 are not arranged on the diaphragm 810 of the speaker apparatus covering the display panel of the monitor. Furthermore, if the transparent material forming the diaphragm 810 has function as a display filter for reducing a reflection of external light and blocking electromagnetic waves, it also can serve as an OA filter that is used widely for displays, thus further improving convenience.

In addition, the diaphragm 810 also can serve as a protective plate on a display screen of the monitor.

Next, in a position of an object generating a sound wave on a picture that is displayed on the monitor of the computer, the corresponding sound image is localized by the technique of localizing the sound image described in the second embodiment. In this manner, the picture and the sound image match, thereby providing audio-visual environment with still more reality to the user.

Ninth Embodiment

A speaker apparatus of the ninth embodiment of the present invention will be described, with reference to the accompanying drawings.

The speaker apparatus of the ninth embodiment is obtained by devising the configuration of the speaker apparatus of the invention of the present application that has been described in the above embodiments. That is, the speaker apparatus is integrated with a keyboard of a personal computer.

Figure 9:
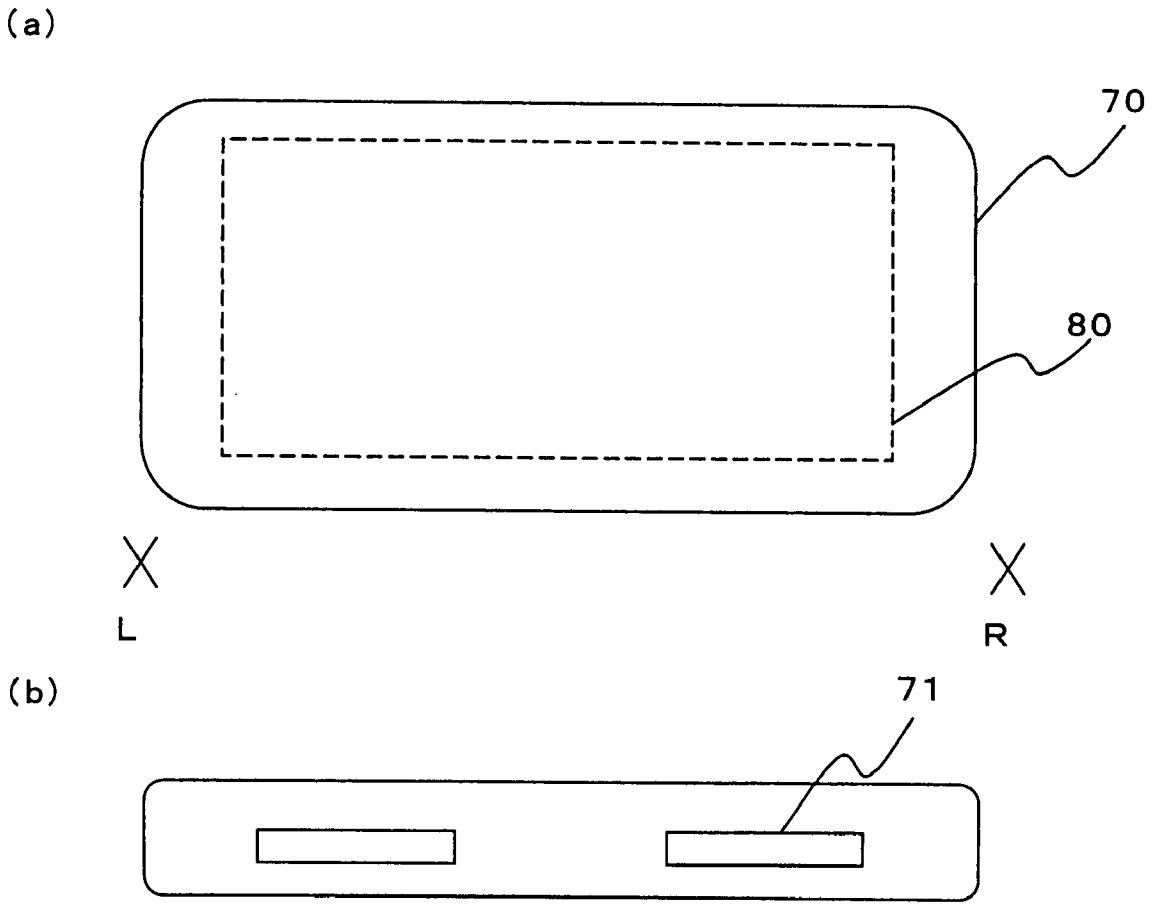
FIG. 9 is a schematic diagram of a configuration of a keyboard as a major part that is integrated with a speaker apparatus of a ninth embodiment of the present invention.
Figure 10:
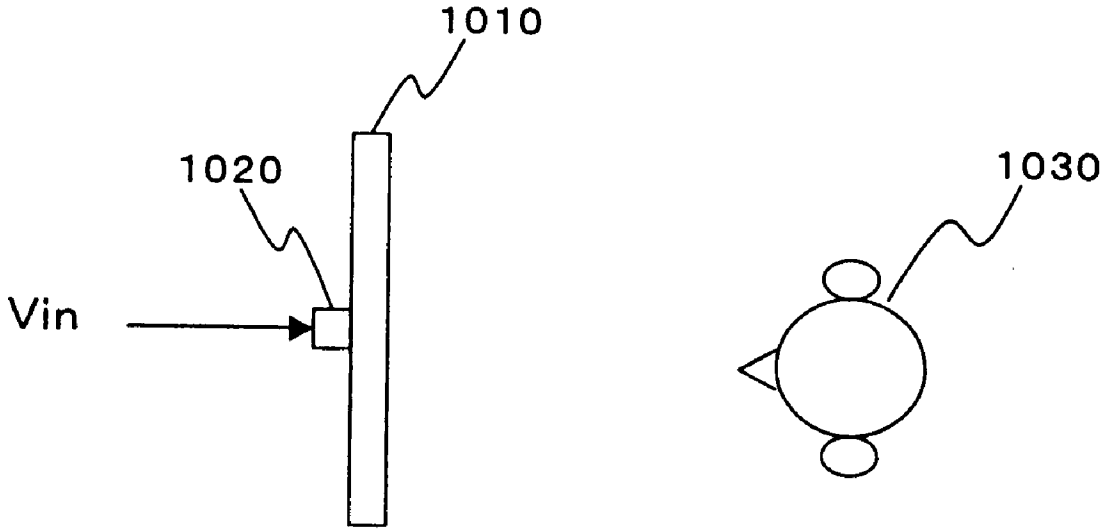
FIG. 10 (PRIOR ART)
FIG. 10 illustrates a concept of a flat-panel speaker apparatus in the prior art.
Figure 11:
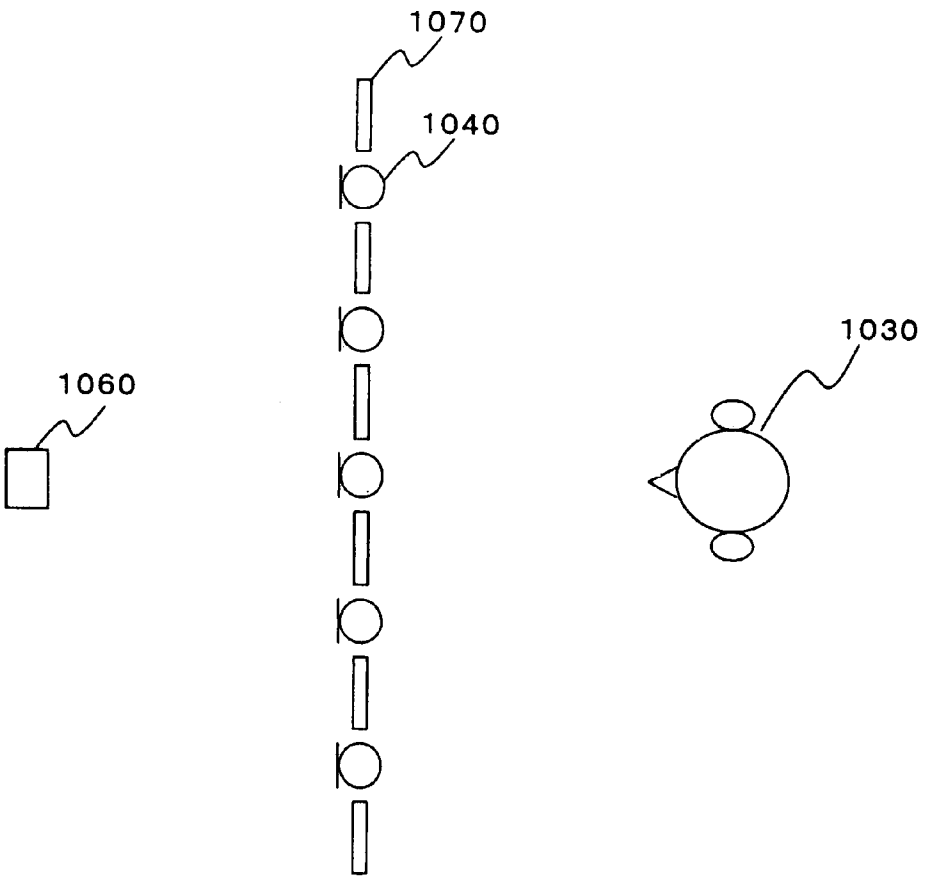
FIG. 11 (PRIOR ART)
FIG. 11 illustrates a concept of recording in the prior art.
Figure 12:
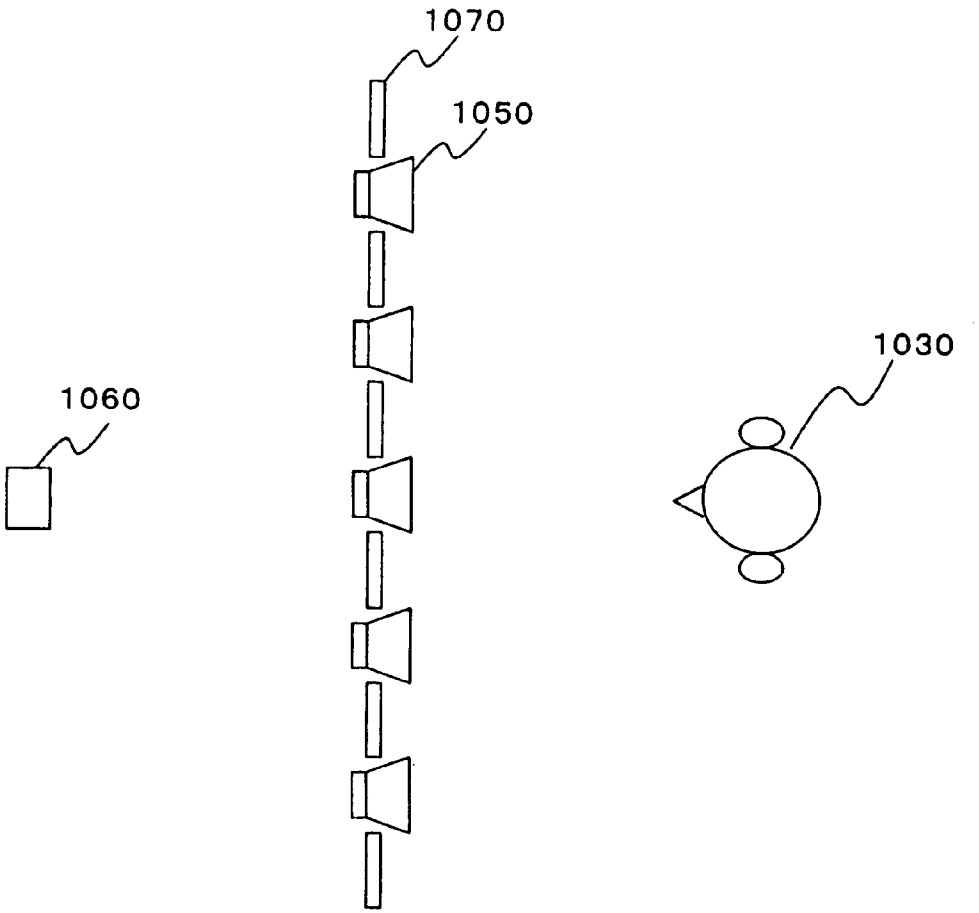
FIG. 12 (PRIOR ART)
FIG. 12 illustrates a concept of reproducing in the prior art.
Figure 13:
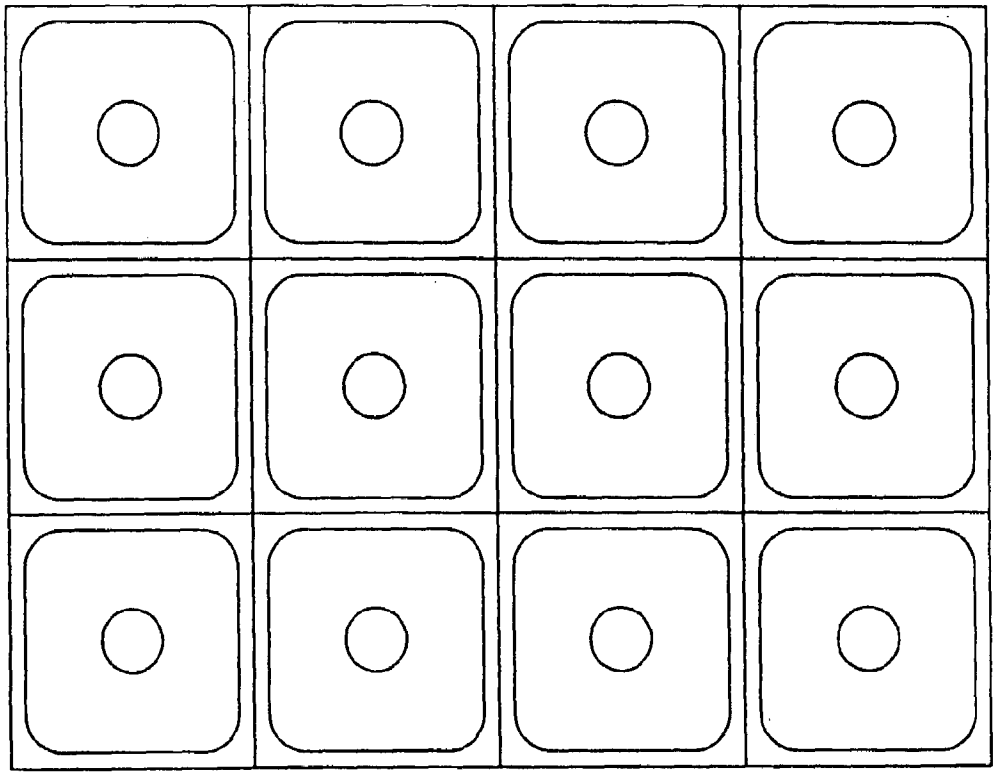
FIG. 13 (PRIOR ART)
FIG. 13 illustrates a speaker wall (a speaker array) in which many speaker apparatus of the prior art are arranged on a wall surface.

FIG. 9 is a schematic diagram of the configuration of the keyboard as a major part that is integrated with the speaker apparatus of the ninth embodiment. FIG. 9(*a*) shows the keyboard seen from the top, and FIG. 9(*b*) shows the keyboard seen from the near front side. In FIG. 9, numeral 70 denotes a keyboard, and localization positions L and R indicate positions in which signals of the respective channels localize a sound image. The other structures such as key tops of the keyboard, a support member and wiring are omitted here. As shown in FIG. 9, a speaker apparatus 80 of the present invention, which is indicated by a dotted line, is installed in an internal space of the keyboard 70, and a sound wave generated in the internal space of the keyboard 70 is outputted from slits 71 serving as a sound outlet.

In the ninth embodiment, the sound images of left and right channels are localized in their respective localization positions L and R by using the technique of localizing the sound image in an arbitrary position described in the second embodiment and the sound image localization technique applied when the diaphragm 10 is covered with the casing described in the sixth embodiment.

Although the speaker apparatus 80 of the present invention has been installed in the internal space of the keyboard 70 here, it may be installed on the back surface of the keyboard 70. In this case, it is necessary that the speaker apparatus 80 of the present invention that is located on the back surface of the keyboard 70 should not be pressed directly against a desk or the like. When the keyboard is tilted using tilt adjustments that are provided in the upper end of the back surface of the keyboard and have been used widely for tilting the keyboard surface toward the user side, the back surface of the keyboard 70 does not contact the desk or the like directly, so that the diaphragm 80 can vibrate in a desired manner.

Also, although one speaker was used here, a plurality of speakers also may be used. In this case, the inside of the keyboard also can be partitioned off.

In addition, a similar method makes it possible to output a multi-channel stereo sound with three or more channels.

In the embodiments described above, the specific numbers of channels for signal input, transducers and filters were only illustrative for the convenience in the description. It is needless to say that they are not intended to limit the present invention.

In the above description, the FIR filter was used as a filter that performs a digital signal processing for causing an interference of the outputs so as to control sound pressure, but the present invention is not necessarily limited to the use of the FIR filter. It is needless to say that any filter can be applied as long as it can perform the digital signal processing for causing signals of a plurality of independent channels to interfere with each other in a desired position so as to control the sound pressure.

In accordance with a speaker apparatus of the present invention, it is possible to provide a plurality of the independent control points to an entire diaphragm of a flat-panel speaker apparatus, and one diaphragm can stereophonically reproduce independent multi-channels, thus reproducing various kinds of tones and stereophonic sound characteristics.

Also, in accordance with the speaker apparatus of the present invention, one control point can vibrate the entire panel, thus increasing a vibrating surface. In other words, one control point vibrates the diaphragm in a larger area than that in a speaker array apparatus in which a plurality of small speakers are integrated in the same area, achieving a better reproducing capability in a low sound range and a larger sound pressure of an output signal.

Furthermore, in accordance with the speaker apparatus of the present invention, it is possible to achieve a simple configuration, less components, and a low manufacturing cost.

Also, in accordance with the speaker apparatus of the present invention, it is possible to cancel out an interference between one control point and the other control points. Thus, with one diaphragm, multi-channel stereophonic characteristics from a plurality of the independent control points can be obtained.

In addition, in accordance with the speaker apparatus of the present invention, in signals to be supplied to control points, it is possible to include a signal for causing an interference between their outputs in a desired position. Thus, a sound image can be localized using an arbitrary point as a control target point, thereby outputting richer sound quality and more stereophonic sound characteristics. Also, it is possible to correct and adjust frequency characteristics of an output in the listening position and listening direction of the listener, thus providing the output with a high quality. This improves flexibility in an installation position and an installation direction of the speaker apparatus.

Also, in accordance with the speaker apparatus of the present invention, the diaphragm is formed of a transparent material so as to be attached to a front surface of a display of a monitor, making it possible to organize a preferable signal outputting environment, and the display can be seen without any problem. It also is possible to localize the sound image in a position of a picture of an object outputting a sound wave in a picture on the monitor. In this case, a viewer enjoys pictures and sound characteristics with more feeling of reality and experience.

Moreover, the speaker apparatus of the present invention can be integrated with a keyboard, thereby contributing to space saving.

The invention claimed is:

1. A speaker apparatus comprising:

a transducer for converting an input electric signal into mechanical vibration; and a single diaphragm for converting the mechanical vibration into a sound signal;

wherein said single diaphragm is provided with a plurality of the transducers, and the single diaphragm is provided with a plurality of independent signal control points corresponding to the respective transducers, and wherein a sound signal processing portion that is able to individually control the input electric signal to the respective transducers is installed, and an electric signal including a sound signal component for outputting a signal at the signal control point corresponding to the respective transducers and a sound interference canceling signal component for canceling, at the signal control point, an interference with the transducers serving as the other signal control points is provided, thereby making it possible to stereophonically reproduce a plurality of channels by the single diaphragm.

2. The speaker apparatus according to claim 1, wherein the input electric signal to the respective transducers includes an interference sound signal component for causing an interference between signal outputs from the plurality of the signal control points so as to localize a sound image in an arbitrary point.

3. The speaker apparatus according to claim 2, wherein the interference sound signal includes information for controlling a sound pressure distribution so as to control directionality of the sound image.

4. The speaker apparatus according to claim 3, wherein the interference sound signal includes a frequency characteristics correcting signal for correcting and adjusting frequency characteristics of an interference sound with respect to an arbitrary listening position and listening direction.

5. The speaker apparatus according to claim 2, wherein the points in which the sound image is to be localized are arranged around a listener so as to achieve a surround stereo system.

6. The speaker apparatus according to one of claims 1 to 5, wherein the diaphragm extends over an entire surface of a desired speaker array and is provided with the transducers whose number is the same as that of the signal control points of the desired speaker array.

7. The speaker apparatus according to one of claims 2 to 5, wherein the diaphragm extends over an entire surface of a desired speaker array, and the sound images are localized in positions of the signal control points of the desired speaker array.

8. The speaker apparatus according to one of claims 2 to 5, wherein the transducers are arranged in a peripheral portion of the diaphragm.

9. The speaker apparatus according to claim 8, wherein the diaphragm is formed of a transparent material.

10. The speaker apparatus according to claim 9, wherein the diaphragm is attached to a front surface of a display of a monitor.

11. The speaker apparatus according to claim 10, wherein the transparent material has function as a display filter for reducing a reflection of external light and blocking electromagnetic waves.

12. The speaker apparatus according to one of claims 1 to 5 that is integrated with a keyboard.

13. A speaker apparatus comprising:

a transducer for converting an input electric signal into mechanical vibration; and a single flat-panel diaphragm for converting the mechanical vibration into a sound signal, wherein said single flat-panel diaphragm is provided with a plurality of the transducers, and the single flat-panel diaphragm is provided with a plurality of independent signal control points corresponding to the respective transducers, and wherein a sound signal processing portion that is able to individually control the input electric signal to the respective transducers is installed, and an electric signal including a sound signal component for outputting a signal at the signal control point corresponding to the respective transducers and a sound interference canceling signal component for canceling, at the signal control point an interference with the transducers serving as the other signal control points is provided, thereby making it possible to stereophonically reproduce a plurality of channels by the single diaphragm.

* * * * *